US006435858B1

(12) United States Patent
Cormier et al.

(10) Patent No.: US 6,435,858 B1
(45) Date of Patent: Aug. 20, 2002

(54) CANDLE SNUFFER

(76) Inventors: Sharon K. Cormier, 443 Buff Cap Rd., Tolland, CT (US) 06084; Simone M. Dion, 386 Neipsic Rd., Glastonbury, CT (US) 06033

( * ) Notice: Subject to any disclaimer, the term of this patent is extended or adjusted under 35 U.S.C. 154(b) by 0 days.

(21) Appl. No.: 09/690,610

(22) Filed: Oct. 17, 2000

(51) Int. Cl.[7] ..... F23Q 25/00
(52) U.S. Cl. ..... 431/120; 431/144; 294/99.2
(58) Field of Search ..... 431/33.12, 144; 81/427; 294/99.2, 8.5, 11, 33; D29/127; 606/205, 210

(56) References Cited

U.S. PATENT DOCUMENTS

| | | | | | |
|---|---|---|---|---|---|
| 486,963 | A | * | 11/1892 | Bartholomew | 294/11 |
| 981,354 | A | * | 1/1911 | Anderson | 294/99.2 |
| 1,806,441 | A | * | 5/1931 | Bauer et al. | 294/99.2 |
| 2,573,922 | A | * | 11/1951 | Meyer | 294/99.2 |
| D254,466 | S | | 3/1980 | Carson | |
| 4,497,374 | A | | 2/1985 | Millar | |
| 4,923,234 | A | * | 5/1990 | Fairley | 294/99.2 |
| 5,282,737 | A | | 2/1994 | Ray | |
| D406,409 | S | | 3/1999 | Rubino | |
| 5,971,081 | A | | 10/1999 | Stewart | |
| 5,989,012 | A | | 11/1999 | Umfleet | |

FOREIGN PATENT DOCUMENTS

| | | | | |
|---|---|---|---|---|
| DE | 2725846 A1 | * | 12/1978 | 431/120 |
| GB | 2349686 A | * | 11/2000 | 431/144 |
| NO | 14706 | * | 12/1905 | 294/99.2 |

* cited by examiner

*Primary Examiner*—Sara Clarke
(74) *Attorney, Agent, or Firm*—Joseph R. Birkner

(57) ABSTRACT

A candle snuffer which extinguishes a burning candle flame without residual smoke and simultaneously trims a charred end of a candlewick is disclosed. The candle snuffer fabricated from a wire member, has a loop formed in the wire member midway between a first end and a second end of the wire member and a pair of quenching tabs disposed on each end of the wire member. The pair of quenching tabs oppose each other and are sufficiently spaced apart to define a gap to interpose the candlewick of the burning candle flame therebetween, whereby when the pair of quenching tabs are urged together into contact with the candlewick by squeezing the pair of arms, the burning candle flame is instantaneously quenched without residual smoke while the charred end of the candlewick is simultaneously trimmed.

9 Claims, 1 Drawing Sheet

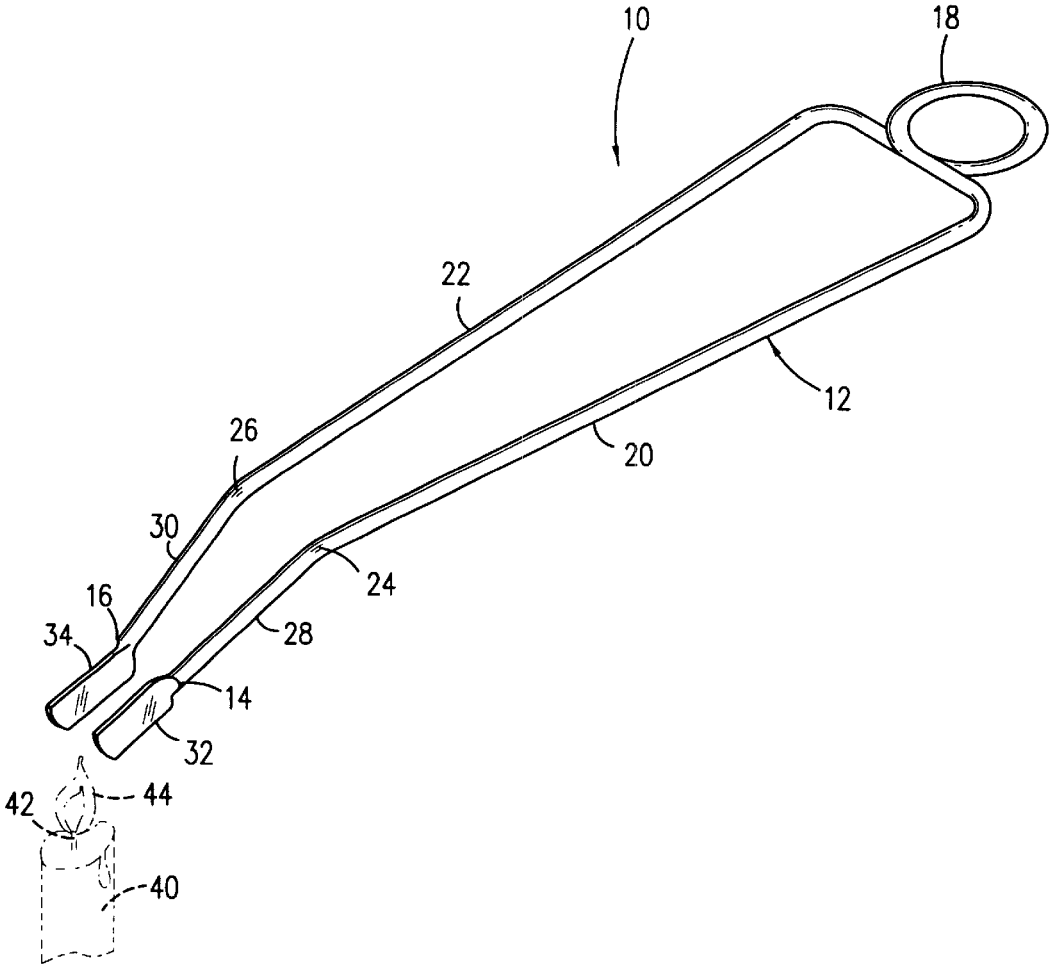
10
18
22
12
26
20
30
24
16
28
34
14
32
42
44
40

CANDLE SNUFFER

FIELD OF THE INVENTION

This invention relates generally to a burning candle flame extinguishing device. More particularly, the present invention relates to a candle snuffer for use in extinguishing a flame of a burning candle without creating smoke and for simultaneously trimming a charred end of a candlewick.

BACKGROUND OF THE INVENTION

The widespread use of candles is a very popular and pleasant endeavor for personal enjoyment and for ceremonial applications. Extinguishing a flame of a burning candle is typically accomplished by blowing it out or by using a bell shaped candle snuffer. These methods create lingering smoke which adversely affect persons allergic to smoke such as those with asthma or with other respiratory conditions. Furthermore, the problem with blowing out candles is that there is a potential danger of accidentally getting burned from the hot candle wax which, more often than not, is sprayed over a table setting and onto other places where it is unwanted making it difficult to clean off a tablecloth or other such articles or on other places where it is deposited.

Also, it is important that the candle wick be vertically oriented and be properly trimmed for efficient candle burning; however, prior art candle flame extinguishing devices and methods are not capable of simultaneously trimming the charred end of the candlewick during use. Such devices and methods require that a candlewick be separately trimmed by a user who typically does not normally conscientiously accomplish this bothersome task. The end result is that the candlewick is not vertically positioned nor is the candlewick trimmed to remove the charred end and therefore the candle may eventually drip and burn unevenly and may even create smoke while burning. Attempts by earlier inventors to provide a practical smokeless candle snuffing and candlewick trimming device have generally resulted in failure to deliver such a needed device.

U.S. Pat. No. 5,282,737 to Ray discloses a tong-like candle snuffer having various wettable snuffing surfaces of wire mesh, wood and ceramic materials. Such a device relies upon a water supply for wetting the wettable snuffing surfaces and is impractical.

U.S. Des. Pat. No. 406,409 to Rubino shows an ornamental candle snuffer.

U.S. Pat. No. 5,971,081 to Stewart discloses a squeezable-type and tweezer-like candle snuffer with removably attachable wax pads attached to the tip of the tweezer-like device. The wax pads could ignite making the design dangerous to use. Also, separately attachable pads are not practical and are inconvenient to attach and to use.

U.S. Patent Des. No. 254,466 to Carson shows a tea bag squeezer with perforated flattened ends on the distal ends of a tong. This design is not practical for use as a candle snuffer; furthermore, even if it were to be used, residual smoke would flow through the perforations.

U.S. Pat. No. 5,989,012 to Umfleet discloses a wire shaped smokeless snuffer which dips a lit candlewick into a pool of hot wax in an attempt to extinguish the flame. This is a dangerous operation. Also, the candlewick is disoriented and is not simultaneously trimmed.

U.S. Pat. No. 4,497,374 to Millar discloses a fork-like candle snuffer member with tines which does not prevent residual smoke from emitting from the extinguished candle.

None of the above prior art devices disclose a candle snuffer which uses a unitary formed wire having a flattened snuffing means at the distal ends thereof which eliminates smoke and one which is simple in design and is easy to use which simultaneously trims the charred end of the candlewick.

In view of the above mentioned problems and limitations associated with conventional candle flame snuffing devices, it was recognized by the present inventor that there is an unfulfilled need for an improved candle snuffer which is simple in design, practical, fun to use and is economically manufactured.

Accordingly, it becomes clear that there is a great need for a candle snuffer which overcomes the disadvantages of the prior art candle flame extinguishing devices. Such a candle snuffer should be one that eliminates the residual smoke emitted from the candlewick of a quenched candle flame and simultaneously trims the charred end of the candlewick.

SUMMARY OF THE INVENTION

It is therefore an object of this invention to provide a candle snuffer that eliminates the residual smoke emitted from the candlewick of a quenched candle flame and simultaneously trims the charred end of the candlewick which avoids the aforementioned problems of prior art devices.

It is a further object of this invention to provide a candle snuffer which may be manufactured from readily available materials by conventional manufacturing processes.

It is a still a further object of this invention to provide a candle snuffer that is simple in design, simple to manufacture, low in cost and fun to use.

This invention results from the realization that there is a great need for an improved candle snuffer. The resulting invention provides a user the capability of conveniently being able to enjoy using candles without the problem of lingering residual smoke and odor caused when a candle is extinguished as well as the problem of having to trim the candlewick.

The above and the other objects are achieved in accordance with the present invention, which, according to a first aspect, provides a candle snuffer which extinguishes a burning candle flame without residual smoke and simultaneously trims a charred end of a candlewick. The candle snuffer fabricated from a wire member, has a loop formed in the wire member midway between a first end and a second end of the wire member and a pair of arms extending from the loop and terminating at a pair of knees. A pair of legs angularly extend from the pair of knees. A pair of quenching tabs are disposed on each end of the wire member such that the pair of quenching tabs oppose each other and are sufficiently spaced apart to define a gap to interpose the candlewick of the burning candle flame therebetween, whereby when the pair of quenching tabs are urged together into contact with the candlewick by squeezing the pair of arms, the burning candle flame is instantaneously quenched without residual smoke while the charred end of the candlewick is simultaneously trimmed.

The second aspect is a special case of the first aspect of this invention with additional features.

According to a second aspect of the invention the pair of legs extend at an angle of about 30 degrees from the pair of knees wherein the pair of legs are shorter than the pair of arms. A pair of quenching tabs are integrally formed from the wire member.

According to a third aspect of the invention, disclosed is a method for making a candle snuffer which simultaneously extinguishes a burning candle flame and trims a charred end of a candlewick.

According to a fourth aspect of the invention, disclosed is a method for extinguishing a burning candle flame and simultaneously trimming a charred end of a candlewick.

BRIEF DESCRIPTION OF THE DRAWINGS

In the accompanying drawing:

The FIGURE is a perspective view of a preferred embodiment of a candle snuffer of the instant invention shown with a burning candle flame of a candle having a candlewick, each candle portion shown in phantom.

DETAILED DESCRIPTION OF PREFERRED EMBODIMENTS

Looking more particularly to the drawing, there is shown in the FIGURE a preferred embodiment of a candle snuffer which is generally indicated at 10, according to a preferred embodiment of the present invention, The FIGURE is a perspective view of a preferred embodiment of a candle snuffer 10 of the instant invention shown with a burning candle flame 44 of a candle 40 having a candlewick 42, each candle portion shown in phantom. It is understood that the candle snuffer 10 can simultaneously extinguish and trim the burnt end portion of a candlewick without residual smoke in a single operation.

As seen in the FIGURE, the candle snuffer 10, constructed from a wire member 12, has a loop 18 formed midway between a first end 14 and a second end 16 of the wire member 12 and a pair of arms 20,22 extending from the loop 18 and terminating at a pair of knees 24,26. The loop 18 acts as a return spring when the pair of arms 20,22 are squeezed and are alternately released. A pair of legs 28,30 angularly extend from the pair of knees 24,26. Preferably, the pair of legs 28,30 are shorter than the pair of arms 20,22. A pair of quenching tabs 32,34 are disposed on each end 14,16 of the wire member 12 such that the pair of quenching tabs 32,34 oppose each other and are sufficiently spaced apart to define a gap to interpose the candlewick 42 of the burning candle flame 44 therebetween. When the pair of quenching tabs 32,34 are urged together into contact with the candlewick 42 by squeezing the pair of arms 20,22, the burning candle flame 44 is instantaneously quenched without residual smoke while the charred end of the candlewick 42 is simultaneously trimmed.

The candle snuffer 10 may be fabricated from readily available materials and by conventional metal fabrication techniques. For example, the wire member 12, from which the candle snuffer 10 may be made, is a material chosen from the group consisting of steel, iron, brass, copper and aluminum. For ease of manufacture and for durability, the wire member 12 may preferably have a diameter of about 3/16 inch (0.5 cm). Preferably, the loop 18 may be formed by wrapping the wire member 12 around a mandrel. The pair of quenching tabs 32,34 may be integrally formed on the ends 14,16 of the wire member 12 by swaging. The formed pair of quenching tabs 32,34 preferably being elongated in shape and have a flat face. The pair of quenching tabs 32,34 have a thickness less than the diameter of the wire member 12. It is understood that jigs and fixtures can also be used to facilitate forming and bending of the wire member 12 to define the candle snuffer 10 of the FIGURE. Furthermore, although not necessary for operation, the wire member 12 of the candle snuffer 10 may, preferably, have a flame resistant coating such as a paint.

To use the candle snuffer 10, a user simply brings the pair of quenching tabs 32,34 into mutually opposing relationship with each other on either side of the candlewick 42 of the burning candle flame 44 by urging the pair of quenching tabs 32,34 together into contact with the candlewick 42 by squeezing the pair of arms 20,22 formed on the wire member 12 whereby the burning candle flame 44 is instantaneously quenched without residual smoke while the charred end of the candlewick 42 is simultaneously trimmed. The candlewick 42 is also vertically aligned in the same operation.

Surprisingly, the instant invention provides an added advantage and recognizes a problem and adequately and completely addresses an unfulfilled need, in that a candle snuffer 10, in the manner disclosed, in effect, provides a convenient device which eliminates residual smoke and provides the desired above mentioned advantages and benefits to a user. Furthermore, the candle snuffer 10, simultaneously trims a charred end of a wick while extinguishing the burning candle flame.

It is understood that the candle snuffer 10 may be constructed in a wide variety of sizes, colors and style variations. For example, the preferred 30 degree angle and the length of the pair of legs 28,30 allows the pair of quenching tabs 32,34 to conveniently access the candlewick 42 of the candle 40 which would normally not be readily reachable. Such a difficult to reach recessed candlewick 42 is one that is in a relatively deep container such as a votive candle holder and a jar (not shown). Furthermore, the loop 18 may also be utilized for mounting the candle snuffer 10 on a wall. The candle snuffer 10 can also be used on oil lamps having a wick in the manner as described above. One practical advantage of the invention is that it provides a convenient, practical, low cost, candle snuffer 10 which allows a user to conveniently extinguish a burning candle flame without residual smoke while simultaneously trimming a charred end of a candlewick. A further advantage of the invention is that the candle snuffer 10 is designed for ease of manufacture by standard methods and by using readily available materials.

Of course, a wide variety of further uses and advantages of the present invention will become apparent to one skilled in the art.

As disclosed, it is apparent that the instant invention can provide other options. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A candle snuffer which extinguishes a burning candle flame without residual smoke and simultaneously trims a charred end of a candlewick, said candle snuffer comprising:

a wire member, with a flame resistant coating, having a first end and a second end;

a loop formed in said wire member midway between said first end and said second end of said wire member;

a pair of arms extending from said loop and terminating at a pair of knees;

a pair of legs, shorter than said pair of arms, angularly extending from said pair of knees at an angle of about 30 degrees;

a pair of quenching tabs integrally formed from said wire member wherein said pair of quenching tabs are elongated in shape and have a flat face; and have a thickness less than a diameter of said wire member; and said pair of quenching tabs disposed on said first end of said wire member and on said second end of said wire member such that said pair of quenching tabs oppose each other and are sufficiently spaced apart to define a gap to interpose the candlewick of the burning candle flame therebetween, whereby when said pair of quenching tabs are urged together into contact with the candlewick by squeezing said pair of arms, the burning candle flame is instantaneously quenched without residual smoke while the charred end of the candlewick is simultaneously trimmed.

2. The candle snuffer of claim 1 wherein said candle snuffer is fabricated from a material chosen from the group consisting of steel, iron, brass, copper and aluminum.

3. The candle snuffer of claim 1 wherein said flame resistant coating is a paint.

4. A candle snuffer which extinguishes a burning candle flame without residual smoke and simultaneously trims a charred end of a candlewick, said candle snuffer comprising:

a wire member having a first end and a second end;

said wire member has a flame resistant coating wherein said flame resistant coating is a paint;

a loop formed in said wire member midway between said first end and said second end of said wire member;

a pair of arms extending from said loop and terminating at a pair of knees;

a pair of legs extending at an angle of about 30 degrees from said pair of knees wherein said pair of legs are shorter than said pair of arms;

a pair of quenching tabs integrally formed from said wire member, and said pair of quenching tabs disposed on said first end of said wire member and on said second end of said wire member such that said pair of quenching tabs oppose each other and are sufficiently spaced apart to define a gap to interpose the candlewick of the burning candle flame therebetween, whereby when said pair of quenching tabs are urged together into contact with the candlewick by squeezing said pair of arms, the burning candle flame is instantaneously quenched without residual smoke while the charred end of the candlewick is simultaneously trimmed.

5. The candle snuffer of claim 4 wherein said pair of quenching tabs are swaged and are elongated in shape and have a flat face.

6. The candle snuffer of claim 4 wherein said pair of quenching tabs have a thickness less than a diameter of said wire member.

7. The candle snuffer of claim 4 wherein said candle snuffer is fabricated from a material chosen from the group consisting of steel, iron, brass, copper and aluminum.

8. A method for making a candle snuffer which simultaneously extinguishes a burning candle flame and trims a charred end of a candlewick comprising the steps of:

providing a wire member having a first end and a second end, forming a loop in said wire member midway between said first end and said second end of said wire member by wrapping said wire member around a mandrel;

defining a pair of arms extending from said loop and terminating at a pair of knees;

defining a pair of legs angularly extending from said pair of knees;

forming a pair of quenching tabs on said first end of said wire member and on said second end of said wire member by swaging; and applying a flame resistant coating to said wire member.

9. A method for extinguishing a burning candle flame and simultaneously trimming a charred end of a candlewick comprising the steps of:

bringing a pair of quenching tabs which are disposed on a first end and on a second end of a wire member of a candle snuffer into mutually opposing relationship with each other on either side of the candlewick; said pair of quenching tabs and said candle snuffer having material properties specifically chosen for trimming a charred end of the candlewick without compression of, or the need for, a non flammable absorbent pad on which residue deposit from the charred candlewick end remains embedded thereon and for simultaneously quenching a candle flame; and urging said pair of quenching tabs together into contact with the candlewick by squeezing a pair of arms formed on said wire member whereby the burning candle flame is instantaneously quenched without residual smoke while the charred end of the candlewick is simultaneously trimmed.

* * * * *